US007004572B2

(12) United States Patent
Pinard

(10) Patent No.: US 7,004,572 B2
(45) **Date of Patent: *Feb. 28, 2006**

(54) INK JET PRINTING SYSTEM WITH INTERLEAVING OF SWATHED NOZZLES

(75) Inventor: Adam I. Pinard, Carlisle, MA (US)

(73) Assignee: Creo Inc., Burnaby (CA)

( * ) Notice: Subject to any disclaimer, the term of this patent is extended or adjusted under 35 U.S.C. 154(b) by 115 days.

This patent is subject to a terminal disclaimer.

(21) Appl. No.: 10/613,909

(22) Filed: Jul. 3, 2003

(65) Prior Publication Data

US 2004/0095440 A1 May 20, 2004

Related U.S. Application Data

(63) Continuation of application No. 09/689,370, filed on Oct. 12, 2000, now Pat. No. 6,626,527, which is a continuation-in-part of application No. 09/041,211, filed on Mar. 12, 1998, now Pat. No. 6,511,163.

(51) Int. Cl.
*B41J 2/07* (2006.01)
*B41J 2/12* (2006.01)

(52) U.S. Cl. ..... 347/74; 347/78; 347/79

(58) Field of Classification Search ..... 347/12, 347/15, 41, 43, 73, 74, 77, 78–79, 82, 56, 347/76; 358/1.9

See application file for complete search history.

(56) References Cited

U.S. PATENT DOCUMENTS

| | | | |
|---|---|---|---|
| 3,298,030 A | 1/1967 | Lewis et al. | 347/74 |
| 3,373,437 A | 3/1968 | Sweet et al. | 347/74 |
| 3,562,757 A | 2/1971 | Bischoff | 347/76 |

(Continued)

FOREIGN PATENT DOCUMENTS

| | | |
|---|---|---|
| DE | 3526769 | 1/1987 |
| GB | 2335885 | 10/1999 |
| JP | 60052356 A | 3/1985 |

(Continued)

OTHER PUBLICATIONS

Ghouse, "Simulation of a Nonlinear Fluid System Servo for Drop Flightime Control in an Ink–Jet Printer," Proceedings of the 1978 Summer Computer Simulation Conference, abstract, 1978.

Heinzl and Herz, "Ink–Jet Printing," Advances in Electronics and Electron Physics, vol. 65, pp. 91–171, 1985.

IBM Journal of Research and Development, vol. 21, No. 1, pp. 1–96, Jan. 1997.

Samuelson, "Ink Jet Printing of Color Images, Dither Matrix and Halftone Methods," Department of Electrical Measurements, Lund Institute of Technology, pp. 58–59, Aug., 1985.

*Primary Examiner*—Hai Pham
(74) *Attorney, Agent, or Firm*—Kristofer E. Elbing

(57) ABSTRACT

Disclosed is a continuous ink jet printer that includes an ink jet printing nozzle for a first color positioned to deposit ink drops on a substrate, and a deflection element located proximate an output trajectory of the first ink jet printing nozzle and operative to deflect the ink drops in a swathed pattern as they are deposited on the substrate by the first ink jet printing nozzle. A second ink jet printing nozzle is also provided for the first color positioned to deposit ink drops on the substrate, and a second deflection element is located proximate an output trajectory of the second ink jet printing nozzle and operative to deflect the ink drops in a swathed pattern as they are deposited on the substrate by the second ink jet printing nozzle. Interleaving logic is operative to provide interleaved print data to interleave at least one deflected drop from the first ink jet printing nozzle with a plurality of deflected drops from the second ink jet printing nozzle in parallel offset rasters.

28 Claims, 3 Drawing Sheets

U.S. PATENT DOCUMENTS

| | | | | | |
|---|---|---|---|---|---|
| 3,596,275 | A | | 7/1971 | Sweet | 347/74 |
| 3,723,646 | A | | 3/1973 | Behane et al. | 358/300 |
| 3,827,057 | A | | 7/1974 | Bischoff et al. | 347/79 |
| 3,828,354 | A | | 8/1974 | Hilton | 347/79 |
| 3,895,386 | A | | 7/1975 | Keur et al. | 347/77 |
| 3,928,718 | A | | 12/1975 | Sagae et al. | 358/296 |
| 3,972,052 | A | | 7/1976 | Atumi et al. | 347/78 |
| 3,977,007 | A | | 8/1976 | Berry et al. | 347/15 |
| 4,051,485 | A | | 9/1977 | Yamada | 347/12 |
| 4,065,773 | A | | 12/1977 | Berry | 347/15 |
| 4,069,485 | A | | 1/1978 | Martin | 347/12 |
| 4,085,409 | A | | 4/1978 | Paranjpe | 347/77 |
| 4,232,324 | A | * | 11/1980 | Tsao | 347/41 |
| 4,314,258 | A | | 2/1982 | Donahue et al. | 347/77 |
| 4,321,607 | A | | 3/1982 | Heibein et al. | 347/79 |
| 4,364,057 | A | | 12/1982 | Ebi et al. | 347/81 |
| 4,384,295 | A | | 5/1983 | Lewis et al. | 347/77 |
| 4,395,716 | A | | 7/1983 | Crean et al. | 347/76 |
| 4,424,518 | A | | 1/1984 | Suzuki et al. | 347/9 |
| 4,467,366 | A | | 8/1984 | Bobick et al. | 347/3 |
| 4,525,721 | A | | 6/1985 | Crean | 347/76 |
| 4,562,442 | A | | 12/1985 | Jinnai et al. | 347/76 |
| 4,598,299 | A | | 7/1986 | Koike et al. | 347/79 |
| 4,620,198 | A | | 10/1986 | Behun | 347/43 |
| 4,667,830 | A | | 5/1987 | Nozaki, Jr. et al. | 209/3.1 |
| 4,748,453 | A | | 5/1988 | Lin et al. | 347/41 |
| 4,800,396 | A | | 1/1989 | Hertz | 347/79 |
| 4,942,462 | A | | 7/1990 | Shiota | 358/509 |
| 4,963,882 | A | | 10/1990 | Hickman | 347/41 |
| 4,965,593 | A | * | 10/1990 | Hickman | 347/12 |
| 4,967,203 | A | | 10/1990 | Doan et al. | 347/41 |
| 4,999,646 | A | | 3/1991 | Trask | 347/41 |
| 5,182,803 | A | | 1/1993 | Rodi et al. | 714/47 |
| 5,202,772 | A | | 4/1993 | Muir | 358/1.9 |
| 5,328,438 | A | | 7/1994 | Crowley | 493/187 |
| 5,423,617 | A | | 6/1995 | Marsh et al. | 400/82 |
| 5,534,904 | A | | 7/1996 | Sheinman | 347/75 |
| 5,570,632 | A | | 11/1996 | Cumens et al. | 101/35 |
| 5,696,593 | A | | 12/1997 | Chiba et al. | 358/296 |
| 5,700,692 | A | | 12/1997 | Sweet | 436/50 |
| 5,825,391 | A | | 10/1998 | Yang | 347/106 |
| 5,870,112 | A | | 2/1999 | Kang et al. | 347/9 |
| 5,946,454 | A | | 8/1999 | Shu et al. | 358/1.9 |
| 5,960,933 | A | | 10/1999 | Albrecht | 198/689.1 |
| 5,963,714 | A | * | 10/1999 | Bhattacharjya et al. | 358/1.9 |
| 5,969,733 | A | | 10/1999 | Sheinman | 347/75 |
| 6,003,980 | A | | 12/1999 | Sheinman et al. | 347/78 |
| 6,102,536 | A | | 8/2000 | Jennel | 347/100 |
| 6,106,107 | A | | 8/2000 | Sheinman | 347/75 |
| 6,135,654 | A | | 10/2000 | Jennel | 400/61 |
| 6,295,737 | B1 | | 10/2001 | Patton et al. | 33/18.1 |
| 6,540,315 | B1 | | 4/2003 | Nystrom et al. | 347/12 |
| 6,626,527 | B1 | * | 9/2003 | Pinard | 347/74 |

FOREIGN PATENT DOCUMENTS

| | | | |
|---|---|---|---|
| JP | 60107975 | | 6/1985 |
| JP | 5293955 | A | 11/1993 |
| JP | 5318715 | | 12/1993 |
| JP | 7052525 | A | 2/1995 |
| JP | 2001315316 | A | 11/2001 |
| WO | WO 97/27053 | | 7/1997 |
| WO | WO 97/42034 | | 11/1997 |

* cited by examiner

INK JET PRINTING SYSTEM WITH INTERLEAVING OF SWATHED NOZZLES

CROSS-REFERENCE TO RELATED APPLICATION

This application is a continuation of an application entitled "Printing System," Ser. No. 09/689,370, filed on Oct. 12, 2000, now U.S. Pat. No. 6,626,527, which is a continuation-in-part of an application entitled "Printing System," filed on Mar. 12, 1998, Ser. No. 09/041,211, U.S. Pat. No. 6,511,163, both of which are herein incorporated by reference.

FIELD OF THE INVENTION

This invention relates to jet printers, including jet printers for direct-to-plate printing systems.

BACKGROUND OF THE INVENTION

Ink-jet printers operate by charging drops of ink with a charging electrode and guiding them to a print substrate through a high intensity electric field. Printers can modulate the charge on an ink drop by changing the charging electrode voltage to select whether each drop is to be printed or instead sent to a gutter. Printers may also adjust the charging voltage to compensate for aerodynamic effects and for the influence of the charge from adjacent drops. Some printers employ a technique known as "swathing" to continuously change the field and thereby direct drops from one or more stationary ink jets to different locations on the printing substrate, instead of moving a print head across the substrate.

Jet printing techniques are applicable to direct-to-plate printers. Such printers typically apply a printing fluid to a sheet of plate stock mounted on a drum. This fluid causes changes in the portions of the surface of the plate on which it is deposited. Although further processing of the plate may be necessary, the result is a printing plate that can serve to print large numbers of pages.

SUMMARY OF THE INVENTION

In one general aspect, the invention features a continuous ink jet printer that includes an ink jet printing nozzle for a first color positioned to deposit ink drops on a substrate, and a deflection element located proximate an output trajectory of the ink jet printing nozzle and operative to deflect the ink drops in a swathed pattern as they are deposited on the substrate by the first ink jet printing nozzle. A second ink jet printing nozzle is also provided for the first color positioned to deposit ink drops on the substrate, and a second deflection element is located proximate an output trajectory of the second ink jet printing nozzle and operative to deflect the ink drops in a swathed pattern as they are deposited on the substrate by the second ink jet printing nozzle. Interleaving logic is operative to provide interleaved print data to interleave at least one deflected drop from the first ink jet printing nozzle with a plurality of deflected drops from the second ink jet printing nozzle in parallel offset rasters. In preferred embodiments, the interleaving logic can include horizontal interleaving logic. The interleaving logic can include vertical interleaving logic. The interleaving logic can include vertical interleaving logic. The printer can further include a processor portion operative to drive the printer to print half-tone images on a print substrate. The print substrate can be a printing plate. The deflection element can be one of a pair of deflection electrodes. The printer can further include swathing logic that includes a series of different firing order entries that define different deflection amounts for at least one of the deflection elements. The printer can include halftone screening logic, with the first and second ink jet printing nozzles being responsive to the halftone screening logic. The first ink jet printing nozzle and the second ink jet printing nozzle can both be located on a same print head. The first and second ink jet printing nozzles are spaced along a direction of rotation of a drum. The interleaving logic can be operative to cause the first and second ink jet printing nozzles to print simultaneously. The interleaving logic can be operative to cause the first and second ink jet printing nozzles to print drops interleaved with each other during a same pass. The interleaving logic can be operative to cause the first and second ink jet printing nozzles to print drops interleaved with each other during different pass. The interleaving logic can be operative to cause the first and second ink jet printing nozzles to print drops interleaved with each other during a same revolution. The interleaving logic can be operative to cause the first and second ink jet printing nozzles to print drops interleaved with each other during different revolutions. The printer can further include a substrate feed mechanism to feed the substrate. The substrate feed mechanism can include a drum. The first and second ink jet printing nozzles can be in a series of nozzles spaced along a direction of rotation of the drum. The substrate feed mechanism can include a platen. The printer can further include self-interleaving logic operative to further interleave deflected drops from at least one of the first and second ink jet printing nozzles with other deflected drops from that same nozzle.

In another general aspect, the invention features a continuous ink jet printing method that includes firing a first stream of ink drops, deflecting drops in the first stream to create a first swathed deposition pattern, firing a second stream of ink drops, and deflecting drops in the second stream to create a second swathed deposition pattern interleaved with the first swathed deposition pattern.

In preferred embodiments, the steps of firing a first stream and firing a second stream can take place simultaneously. The steps of firing a first stream and firing a second stream can deposit the drops on a drum according to a helical progression over a plurality of revolutions.

In a further general aspect, the invention features a continuous ink jet printer that includes means for firing a first stream of ink drops, means for deflecting drops in the first stream to create a first swathed deposition pattern, means for firing a second stream of ink drops, and means for deflecting drops in the second stream to create a second swathed deposition pattern interleaved with the first swathed deposition pattern.

In preferred embodiments, the printer can further include swathing means that include a series of different firing order entries that define different deflection amounts for at least one of the means for deflecting. The printer can further include halftone screening means and wherein the means for firing are responsive to the halftone screening means. The printer can further include means for feeding a substrate to be printed on by the continuous ink jet printer.

Systems according to the invention can permit printing operations to take place more quickly and efficiently, in moving-head, direct-to-plate, jet printers. Swathing and interleaving can permit such printers to deposit individual charged drops that are spaced apart in two polar dimensions on a plate as it rotates. This allows for fine-pitch printing at high speeds with a minimum number of guard drops.

DETAILED DESCRIPTION OF AN ILLUSTRATIVE EMBODIMENT

Figure 1:
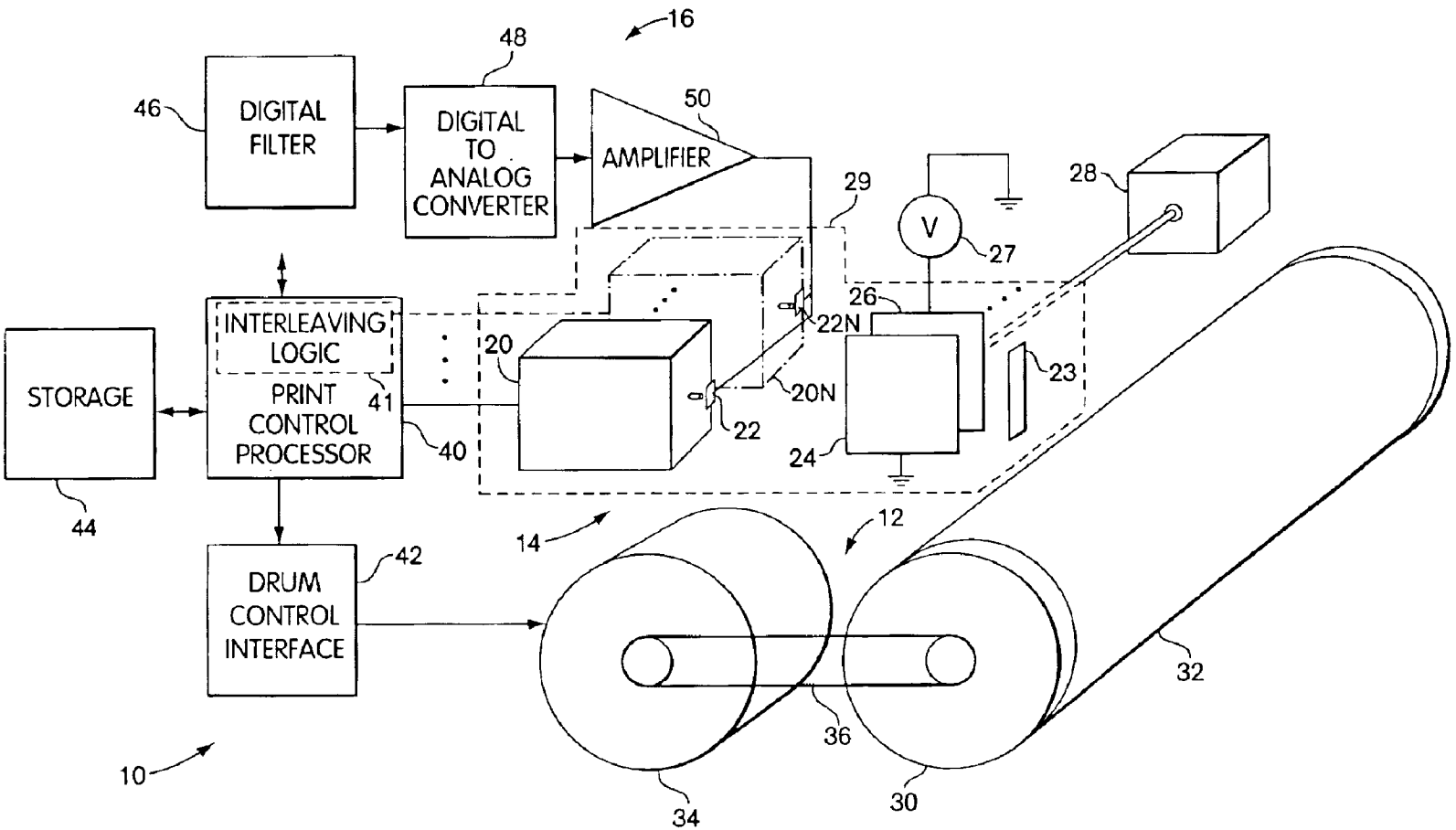
FIG. 1 is a system-level block diagram illustrating elements of a jet printer according to the invention.

A jet printer 10 according to the invention includes a print substrate feed mechanism 12, a print head assembly 14, and a control circuit 16. The feed mechanism includes a print drum 30, which supports a print substrate 32, such as a piece of paper print stock or a printing plate. A motor 34 drives the drum 30 via a coupling mechanism 36.

The print head assembly 14 includes a print head that includes one or more nozzle assemblies 20 . . . 20 N each having a charging electrode 22 . . . 22N, such as a charging tunnel, at its output. A pair of deflection electrodes (e.g., 24, 26) is located on opposite sides of the path that a drop takes when exiting the nozzle. The deflection electrodes, the charging tunnel, and the nozzle assembly are all mounted on a carriage 29 driven by a carriage actuator 28. The carriage actuator is operative to move the carriage along a path that is parallel to the axis of rotation of the drum.

The control circuit 16 includes a print control processor 40 that can include interleaving logic 41 and has a control output provided to a drum control interface 42. The print control processor also has a data port operatively connected to a data port of a storage element 44, and a data port operatively connected to a digital filter 46. The digital filter has an output provided to a digital input of a digital-to-analog converter 48, which has an analog output provided to an input of a high-voltage amplifier 50. The amplifier has an output that is operatively connected to the charging electrode 22. Also provided is a high-voltage source 27 that can be controlled by the print control processor 40 and that has an output operatively connected to one of the deflection electrodes 26. The other deflection electrode 24 can be operatively connected to a fixed voltage source, such as ground.

FIG. 1 is intended as a general illustration of a printer according to the invention, and one of skill in the art would be able to modify its design in a number of ways while still obtaining benefits from the invention for different applications. For example, a number of different mechanisms can be used for the carriage actuator such as toothed-belt or lead-screw mechanisms. And while a drum-based feed mechanism 12 is appropriate for printing directly on lithographic plates, other printing applications may employ different kinds of mechanisms, such as continuous feed paper on a platten.

Features and functionality of the various circuit elements shown in FIG. 1 can also be combined in different ways. For example, the print control processor 40 can incorporate control routines that control the motor 34, allowing a signal from the print control processor or a simple buffered version of that signal to drive the motor. This eliminates the need for a dedicated hardware drum control circuit 42, which receives only a simple on/off signal from the print control processor. The print control processor can be located inside the printer, or it can be located remote from the printer and communicate with the printer, such as via serial cable.

Note that it is also possible to apply the invention to different types of deflection configurations by modulating the excitation provided to one or more of its deflection elements. For example, it is possible to modulate the voltage on the deflection electrodes 24, 26 instead of, or in addition to, modulating the voltage on the charging electrode 22. In addition, it is also possible to operate a jet printer without a charging electrode and modulate only a voltage on one or more deflection electrodes. It is also possible to modulate other approaches to guiding a drop, such as by modulating a magnetic field instead of an electric field.

Figure 2:
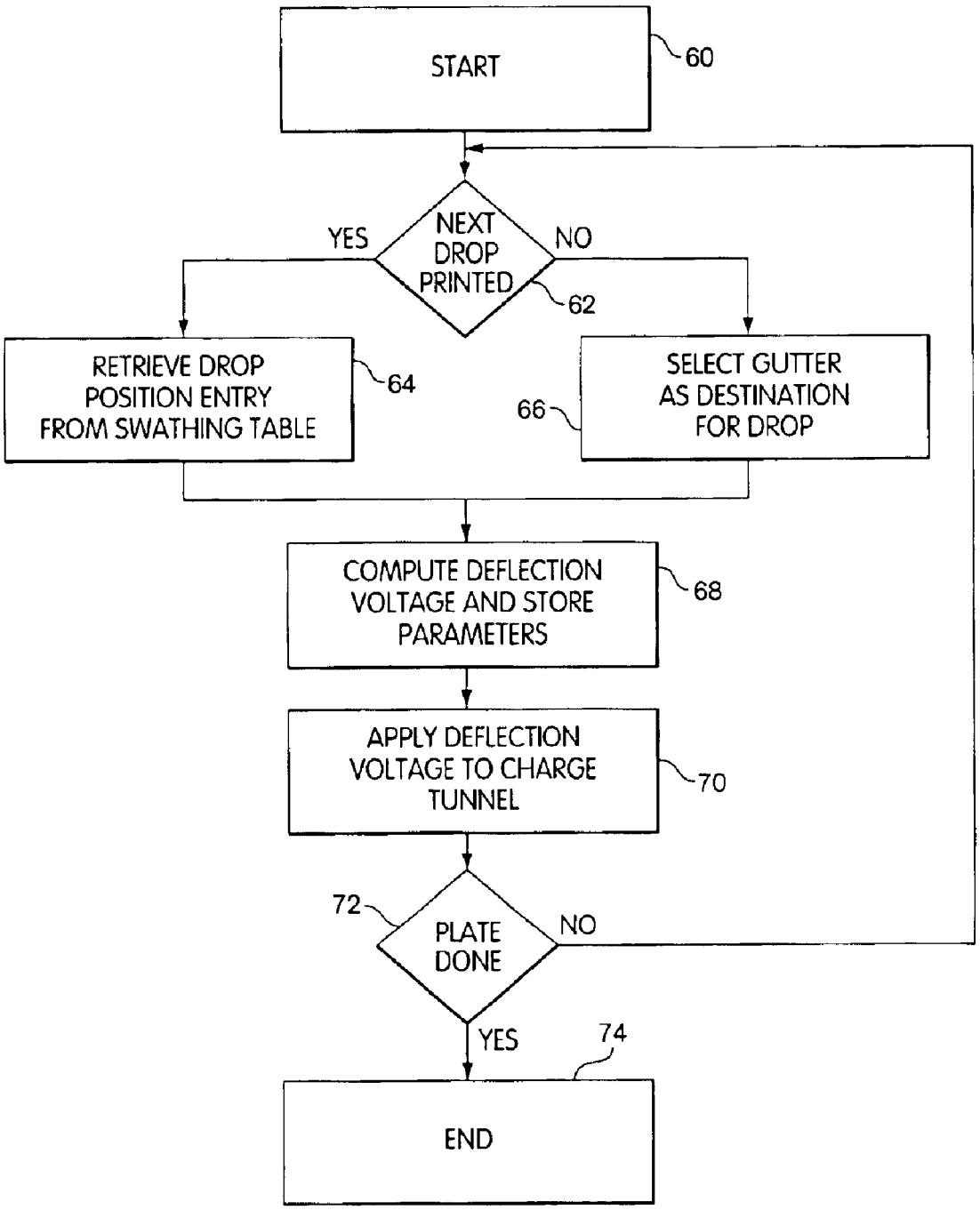
FIG. 2 is a flow chart illustrating the operation of the printer of FIG. 1.

In operation, referring to FIGS. 1 and 2, operation of the jet printer 10 begins with operator set-up of the printer and a software start command (step 60). In the case of a direct-to-plate printer that prints on aluminum or plastic plates, an operator first mounts a fresh plate 32 on the printer's drum 30. The operator then causes a host system to download data representing the material to be printed into the print control processor 40. The print control processor can also download coefficients into the digital filter 46, or run a calibration routine to derive these coefficients, if these are not stored locally. Calibration can be performed by depositing printing fluid drops on a calibration needle and adjusting the filter coefficients until an optimal transfer function has been reached. The processor can then instruct the drum control interface 42 to start the motor 34, which causes the drum 30 to rotate.

After the drum is up to speed, the print control processor 40 instructs the nozzle assembly 20 to generate a series of charged printing fluid drops, which pass through the charging electrode 22 and then between the deflection electrodes 24, 26. The magnitude of the voltage to be applied to the charging electrode 22 by the amplifier 50 depends on whether and where each particular drop is to be printed (step 62). If a drop is not to be printed, such as in the case of a guard drop, the print control processor 40 will select a gutter or knife edge 23 as the destination for the drop (step 66). The print control processor will then compute an appropriate voltage to be applied to the charging electrode given the voltage between the deflection electrodes, to guide the drop into the gutter (step 68). Typically, this voltage is either the maximum or minimum voltage that the amplifier is configured to provide.

If the drop is to be printed, the print control processor 40 retrieves a drop position entry from a swathing table, which can be stored in the storage 44 (step 64). The entries in the swathing table are designed to cause successive, but non-adjacently deposited, drops to be separated from each other on the plate radially due to rotation of the drum and longitudinally due to the swathing. Because the drops are spaced in this way in these two polar dimensions, they will not touch each other. This is particularly important in half-tone printing, where only single, separate drops are deposited. Of course, the order in which the print data is sent to the print head must take the swathing sequence into consideration.

Superimposed on the swathing voltage is a voltage derived by the digital filter 46, which compensates for aerodynamic effects and for the influence of the charge on adjacent drops. The digital filter can be an Infinite-Impulse-Response (IIR) filter implemented using a digital signal processor, such as the TMS 320C203 integrated circuit available from Texas Instruments. The filter function implemented is:

$$\mathrm{OUT}(n)=B0*\mathrm{IN}(n)+B1*\mathrm{IN}(n-1)+B2*\mathrm{IN}(n-3)+A1*\mathrm{OUT}(n-1)+A2*\mathrm{OUT}(n-2)$$

Coefficients used in the function for one embodiment are:

TABLE I

| IIR Coefficients | |
|---|---|
| b0 | 0.05 |
| b1 | 0.67 |
| b2 | −0.32 |
| a1 | 0.6 |
| a2 | 0 |

Where IN(n) represents the desired position of drop number n, and OUT(n) represents the electrode voltage for drop number n resulting from the application of the filter. In a system that has sufficient computational capacity, it is contemplated that further coefficients could be included in this function. Digital filter design is discussed in, for example, "Digital Signal Processing, " Chapter 5, Alan VanOppenheim and Ronald W. Schafer, Prentice-Hall Inc. (1975), which is herein incorporated by reference.

Table 2 illustrates the operation of the digital filter for the initial drops to be printed in a print job. As can be seen from this table, charge interaction between drops and aerodynamic effects cause the filter voltage required to place the drop at a desired position to change from drop to drop.

TABLE 2

| Drop Number | Normalized Desired Drop Position | Normalized Charging Voltage |
|---|---|---|
| 0 | 1 | 0.050 |
| 1 | 1 | 0.750 |
| 2 | 1 | 0.850 |
| 3 | 1 | 0.910 |
| 4 | 1 | 0.946 |
| 5 | 1 | 0.968 |
| 6 | 1 | 0.981 |
| 7 | 1 | 0.988 |
| 8 | 0 | 0.943 |
| 9 | 0 | 0.246 |
| 10 | 0 | 0.147 |
| 11 | 0 | 0.088 |
| 12 | 0 | 0.053 |
| 13 | 0 | 0.032 |
| 14 | 0 | 0.019 |
| 15 | 0 | 0.011 |
| 16 | 0 | 0.007 |

Once the charging voltage has been computed, the digital filter supplies a code corresponding to that voltage to the digital-to-analog converter 48. The digital-to-analog converter converts this code into an analog voltage, which it presents on its analog output. The amplifier 50 then amplifies the analog voltage to a high level, which is applied to the charging electrode 22 (step 70).

When a final drop has been sent (step 72), the printer can be powered down, or a new print operation can begin (step 74). If drops remain to be printed, the process of determining a charging electrode voltage begins again for the next drop (step 62).

In one particular embodiment, a printer employs a continuous jet head that has multiple jet assemblies and employs swathed bitmap capability to print up to 16 rasters per revolution per channel in a helical progression about the drum. This high resolution bitmap capability allows every drop to be used on halftone images without any of them merging.

It has been empirically determined that 1200 dots per inch (DPI) can be accomplished using a 10 um nozzle at jet velocity of 50 m/s printing a 16 pixel wide swath with a firing order of: 0, 8, 4, 12, 1, 9, 5, 13, 2, 10, 6, 14, 3, 11, 7, 15. This order is stored as a series of charge values in a 32-entry swathing table that also has an entry for non-printing drops, although other types of swathing tables can be used as well. The separation on the individual charges corresponds to a voltage of approximately 4 volts. This requires a total voltage swing of about 128 volts on the charging electrode. A nominal separation of 64 volts between printed and non-printed drops provides sufficient separation for the knife edge to operate properly.

The deflection voltage on the nozzle assemblies is programmable by software from 0 to 2200 Volts, and the deflection voltages for each nozzle assembly are to be sensed individually. Stimulation is common for all nozzle assemblies and is a square wave with an amplitude that can be controlled from 2.5 to 41 Volts. The charging voltage output has 1024 discrete levels between +35 and −115 Volts with a settling time of 125 ns.

Figure 3:
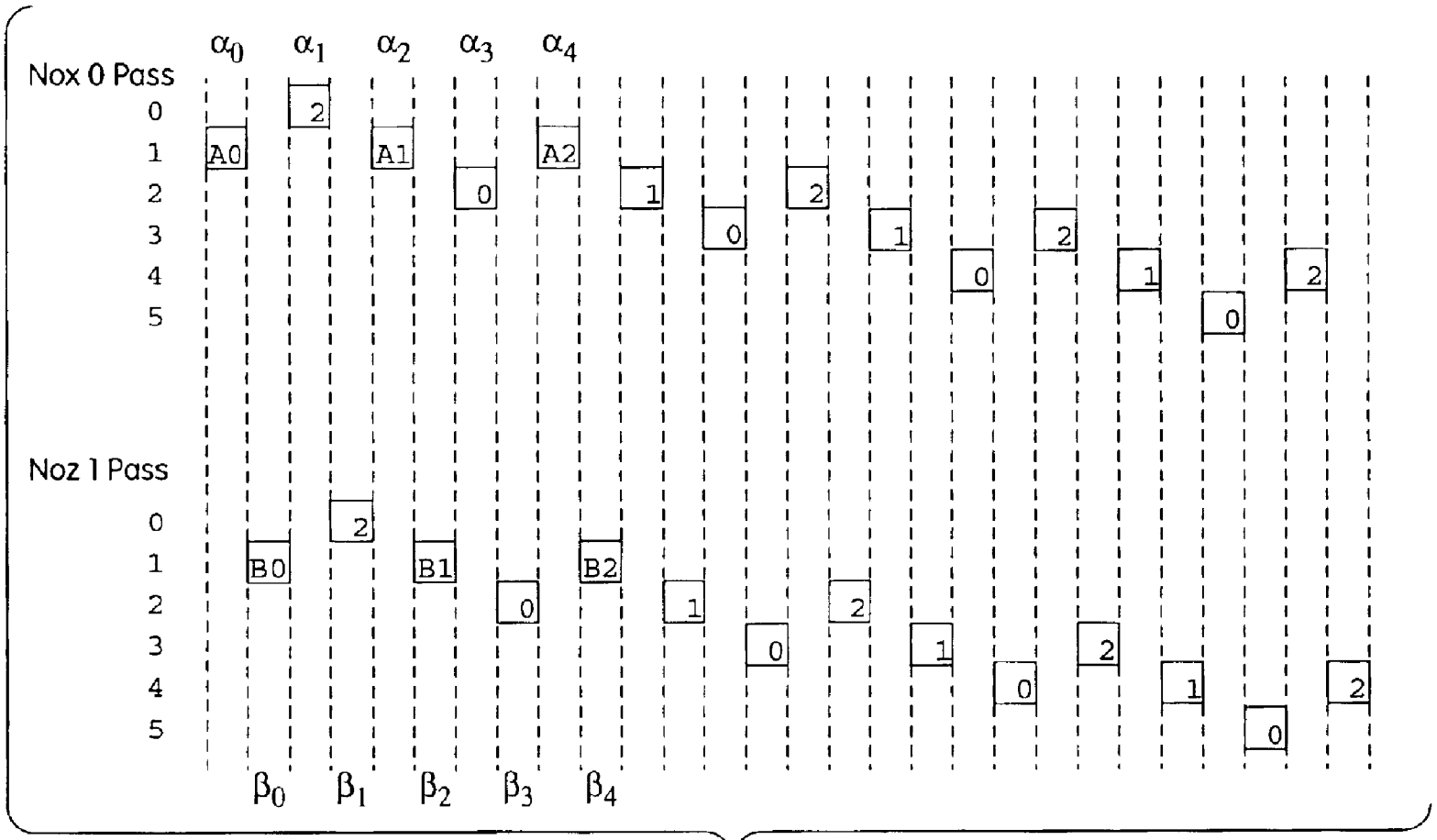
FIG. 3 is an interleaving diagram for a two-nozzle interleaving and three-channel swathing printer.

Referring to FIG. 3, it is advantageous to combine interleaving and swathing in printers according to the invention. In such a system, a print head that includes a series of jets spaced along the direction of rotation of the drum simultaneously prints in parallel swathed helical progressions with offset rasters. This combination of swathing and interleaving allows for fast printing and a high degree of separation of the deposited ink drops.

An illustrative printing sequence is shown in FIG. 3 for a printer with two nozzles that and each employ three-channel swathing, and that are interleaved with each other and with themselves. In this example, a first nozzle deposits its ink drops at equally spaced intervals during a first revolution. During a second revolution, the first nozzle again deposits its ink drops at equally spaced intervals, but places them between the drops deposited during the first revolution.

At the same time, a second nozzle is also depositing its ink drops at equally spaced intervals, but these are offset from the positions used by the first channel, such that they fall in the gaps left by the first nozzle. The result is an interleaved printing sequence where adjacent drops from one jet are printed on different revolutions, and where these drops are also separated by adjacent drops from another jet.

In the illustrated horizontally interleaved print progression, a first jet deposits a first drop A0 in a first stripe $\alpha$0. It then deposits a second drop A1 in a third stripe $\alpha$2. Finally, it deposits a third drop A3 in a fifth stripe $\alpha$4. This pattern begins again as the print head advances with respect to the substrate while printing in even-numbered stripes.

During the same pass of the print head, a second jet is depositing a second swath, at a different position along the direction of rotation of the drum. This second swath begins when the second jet deposits a first drop B0 in a first offset stripe $\beta$1. It then deposits a second drop B1 in a third offset stripe $\beta$2. Finally, it deposits a third drop B2 in a fifth offset stripe $\beta$4. This pattern begins again as the print head advances with respect to the substrate while printing in even-numbered offset stripes.

During the same pass of the next revolution, the first jet will fill in remaining gaps by depositing drops in the odd-numbered stripes (i.e., $\alpha$1, $\alpha$3, etc.). Similarly, the second jet will fill in remaining gaps by depositing drops in the odd-numbered offset stripes (i.e., $\beta$1, $\beta$3, etc.).

The illustrated print order employs horizontal interleaving to separate drops in the direction of the axis of rotation of the drum. This effect can also be accomplished in the direction of rotation of the drum by performing vertical interleaving, in which adjacent print lines are deposited on different passes or even different rotations of the drum. And both horizontal and vertical interleaving can be performed by just a single jet, by interleaving over multiple passes and/or rotations.

For the purpose of clear illustration, the example shown in FIG. 3 employs a left-to-right firing order. It is also advantageous to combine interleaving and jumbled swathing order, however, to achieve a high degree of spacing between drops, and to avoid the creation of Moiré patterns. In one embodiment, it is believed that satisfactory 2400 DPI printing can be accomplished using the interleaving presented in connection with FIG. 3 and a 15-drop swath width. The firing order for this embodiment is 1, 8, 4, 13, 0, 6, 10, 3, 14, 7, 11, 2, 9, 5, 12. By appropriate selection of the type of interleaving and the number of swathing and interleaving channels, printing speed and resolution can be optimized for the deposition characteristics of a particular print head, ink, and substrate combination. Preferably, the carriage and drum are advanced continuously to achieve a smooth and precise helical progression, allowing for high precision deposition of ink drops.

The interleaving can be implemented using interleaving logic that directs appropriate pixels to the interleaved jets. This logic can be implemented in a number of ways, including by the use of dedicated logic circuitry, look-up tables, or software running on a processor, such as a print control processor for a multi-source print head. The logic can be separate from the logic implementing the swathing table, or the two functions may be implemented with some overlap.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto. In addition, the order of presentation of the claims should not be construed to limit the scope of any particular term in the claims.

What is claimed is:

1. A continuous ink jet printer, comprising:

a first ink jet printing nozzle for a first color positioned to deposit ink drops on a substrate, a first deflection element located proximate an output trajectory of the first ink jet printing nozzle and operative to deflect the ink drops from the first nozzle by different amounts such that differently deflected ink drops are deposited in a swathed pattern as they are deposited on the substrate by the first ink jet printing nozzle, a second ink jet printing nozzle for the first color positioned to deposit ink drops on the substrate, a second deflection element located proximate an output trajectory of the second ink jet printing nozzle and operative to deflect the ink drops from the second nozzle by different amounts such that differently deflected ink drops are deposited in a swathed pattern as they are deposited on the substrate by the second ink jet printing nozzle, and interleaving logic operative to provide interleaved print data to interleave at least one deflected drop from the first ink jet printing nozzle with a plurality of deflected drops from the second ink jet printing nozzle in parallel offset rasters.

2. The continuous ink jet printer of claim 1 wherein the interleaving logic includes horizontal interleaving logic.

3. The continuous ink jet printer of claim 2 wherein the interleaving logic includes vertical interleaving logic.

4. The continuous ink jet printer of claim 1 wherein the interleaving logic includes vertical interleaving logic.

5. The continuous ink jet printer of claim 1 further including a processor portion operative to drive the printer to print half-tone images on a print substrate.

6. The continuous ink jet printer of claim 1 wherein the print substrate is a printing plate.

7. The continuous ink jet printer of claim 1 wherein the deflection element is one of a pair of deflection electrodes.

8. The continuous ink jet printer of claim 1 further including halftone screening logic and wherein the first and second ink jet printing nozzles are responsive to the halftone screening logic.

9. The continuous ink jet printer of claim 1 wherein the first ink jet printing nozzle and the second ink jet printing nozzle are both located on a same print head.

10. The continuous ink jet printer of claim 1 wherein the first and second ink jet printing nozzles are spaced along a direction of rotation of a drum.

11. The continuous ink jet printer of claim 1 wherein the interleaving logic is operative to cause the first and second ink jet printing nozzles to print simultaneously.

12. The continuous ink jet printer of claim 1 wherein the interleaving logic is operative to cause the first and second ink jet printing nozzles to print drops interleaved with each other during a same pass.

13. The continuous ink jet printer of claim 1 wherein the interleaving logic is operative to cause the first and second ink jet printing nozzles to print drops interleaved with each other during different passes.

14. The continuous ink jet printer of claim 1 wherein the interleaving logic is operative to cause the first and second ink jet printing nozzles to print drops interleaved with each other during a same revolution.

15. The continuous ink jet printer of claim 1 wherein the interleaving logic is operative to cause the first and second ink jet printing nozzles to print drops interleaved with each other during different revolutions.

16. The continuous ink jet printer of claim 1 further including a substrate feed mechanism to feed the substrate.

17. The continuous ink jet printer of claim 1 wherein the substrate feed mechanism includes a drum.

18. The continuous ink jet printer of claim 17 wherein the first and second ink jet printing nozzles are in a series of nozzles spaced along a direction of rotation of the drum.

19. The continuous ink jet printer of claim 1 wherein the substrate feed mechanism includes a platen.

20. A continuous ink jet comprising:

a first ink jet printing nozzle for a first color positioned to deposit ink drops on a substrate, a first deflection element located proximate an output trajectory of the first ink jet printing nozzle and operative to deflect the ink drops in a swathed pattern as they are deposited on the substrate by the first ink jet printing nozzle, a second ink jet printing nozzle for the first color positioned to deposit ink drops on the substrate, a second deflection element located proximate an output trajectory of the second ink jet printing nozzle and operative to deflect the ink drops in a swathed pattern as they are deposited on the substrate by the second ink jet printing nozzle, interleaving logic operative to provide interleaved print data to interleave at least one deflected drop from the first ink jet printing nozzle with a plurality of deflected drops from the second ink jet printing nozzle in parallel offset rasters, and swathing logic that includes a series of different firing order entries that define different deflection amounts for at least one of the deflection elements.

21. A continuous ink jet printer comprising:

a first ink jet printing nozzle for a first color positioned to deposit ink drops on a substrate, a first deflection element located proximate an output trajectory of the first ink jet printing nozzle and operative to deflect the ink drops in a swathed pattern as they are deposited on the substrate by the first ink jet printing nozzle, a second ink jet printing nozzle for the first color positioned to deposit ink drops on the substrate, a second deflection element located proximate an output trajectory of the second ink jet printing nozzle and operative to deflect the ink drops in a swathed pattern as they are deposited on the substrate by the second ink jet printing nozzle, interleaving logic operative to provide interleaved print data to interleave at least one deflected drop from the first ink jet printing nozzle with a plurality of deflected drops from the second ink jet printing nozzle in parallel offset rasters, and self-interleaving logic operative to further interleave deflected drops from at least one of the first and second ink jet printing nozzles with other deflected drops from that same nozzle.

22. A continuous ink jet printing method, comprising:

firing a first stream of ink drops, deflecting drops in the first stream by different amounts to create a first swathed deposition pattern in which different deposited drops are deflected by different amounts, firing a second stream of ink drops, and deflecting drops in the second stream by different amounts to create a second swathed deposition pattern in which different deposited drops are deflected by different amounts, and wherein the second swathed deposition pattern is interleaved with the first swathed deposition pattern.

23. The method of claim 22 wherein the steps of firing a first stream and firing a second stream take place simultaneously.

24. The method of claim 22 wherein the steps of firing a first stream and firing a second stream deposit the drops on a drum according to a helical progression over a plurality of revolutions.

25. A continuous ink jet printer, comprising:

means for firing a first stream of ink drops, means for deflecting drops in the first stream by different amounts to create a first swathed deposition pattern in which different deposited drops are deflected by different amounts, means for firing a second stream of ink drops, and means for deflecting drops in the second stream to create a second swathed deposition pattern in which different deposited drops are deflected by different amounts, and wherein the second swathed deposition pattern is interleaved with the first swathed deposition pattern.

26. The continuous ink jet printer of claim 25 further including halftone screening means and wherein the means for firing are responsive to the halftone screening means.

27. The continuous ink jet printer of claim 25 further including means for feeding a substrate to be printed on by the continuous ink jet printer.

28. A continuous ink jet printer comprising:

means for firing a first stream of ink drops, means for deflecting drops in the first stream by different amounts to create a first swathed deposition pattern in which different deposited drops are deflected by different amounts, means for firing a second stream of ink drops, means for deflecting drops in the second stream to create a second swathed deposition pattern in which different deposited drops are deflected by different amounts, and wherein the second swathed deposition pattern is interleaved with the first swathed deposition pattern, and swathing means that include a series of different firing order entries that define different deflection amounts for at least one of the means for deflecting.

* * * * *